United States Patent [19]

Meenen

[11] Patent Number: 4,496,337

[45] Date of Patent: Jan. 29, 1985

[54] CONTROL APPARATUS FOR FOLDING MACHINE

[75] Inventor: Raymond P. Meenen, Hawthorne, N.J.

[73] Assignee: Mayflower Electronic Devices Inc., Little Ferry, N.J.

[21] Appl. No.: 511,188

[22] Filed: Jul. 6, 1983

[51] Int. Cl.[3] ..... B65H 45/18

[52] U.S. Cl. ..... 493/14; 493/23; 493/27; 493/38

[58] Field of Search ..... 493/13, 14, 17, 18, 493/19, 20, 23, 25, 937, 38, 15, 442, 12, 27; 72/12, 15

[56] References Cited

U.S. PATENT DOCUMENTS

| | | | |
|---|---|---|---|
| 3,003,760 | 10/1961 | Scheu et al. | 493/27 |
| 3,580,141 | 5/1971 | Richter | 493/27 |
| 3,635,129 | 1/1972 | Cobelo | 493/27 |
| 3,990,693 | 11/1976 | Beahn et al. | 493/38 |
| 4,085,928 | 4/1978 | Sussman | 493/14 |
| 4,264,066 | 4/1981 | Meenen et al. | 493/12 |

*Primary Examiner*—Francis S. Husar
*Assistant Examiner*—William E. Terrell

[57] ABSTRACT

A folding machine having a horizontally elongated input plate with front and rear horizontal edges, a mechanism including input wheels disposed at the rear edge, the mechanism having a first position at which the wheels are disposed above the plate and a second position at which the wheels are lowered to said plate, a horizontally elongated roller rotatable about its own axis and disposed at the rear edge, the wheels being engaged with the roller when the mechanism is in the second position and a motor for rotating the roller. The machine also includes first and second spaced apart photoelectric circuits, each circuit producing a vertical light beam, which, when not interrupted, passes the rear edge, said beams defining a vertical plane, as well as a third photoelectric circuit producing a horizontal light beam which, when not interrupted, passes horizontally along the rear edge parallel to said plane. A first device connected between the first and second circuits and the mechanism is responsive to the interruption of both vertical beams when material to be folded is placed upon the plate in the path of both beams to place the mechanism in the second position, the mechanism being otherwise in the first position.

A second device coupled to the first device, the third circuit and the motor to actuate the motor and rotate the roller only when the mechanism is in the second position and the horizontal beam is not interrupted.

7 Claims, 2 Drawing Figures

CONTROL APPARATUS FOR FOLDING MACHINE

BACKGROUND OF THE INVENTION

One known type of material folding machinery as disclosed for example in U.S. Pat. No. 4,264,066 can be operated by two operators who hold a curtain or other material to be folded flat and relatively wrinkle free, each operator on one side of the material. The leading edge of one piece of the material is lifted from a pile and is inserted into an input feed section between raised input wheels and a horizontal input roller. The operator depress start switches and the input rollers are lowered and press the material against the input roller. As the operators release the start switches, the input roller rotates and the material is fed into the body of the machine wherein the folding operations are carried out.

While the arrangement described above is generally satisfactory, it has been found that operators from time to time do not position the leading edge of the material in proper position whereby the folded material discharged from the machine may be improperly folded with edges showing in undesired manner or otherwise being somewhat unsightly. In addition, if an operator is unskilled and does not move his hands quickly enough after depressing and releasing the start switch, his hands can get caught between the wheels and rotating input roller and injuries can occur.

The present invention is directed toward a new arrangement for such folding materials wherein improperly positioned material will not be folded and wherein an operator cannot get his hands caught in the manner described above.

SUMMARY OF THE INVENTION

In accordance with the principles of this invention, a folding machine has a horizontally elongated input plate with front and rear horizontal edges, a mechanism including input wheels disposed at the rear edge, said mechanism having a first position at which said wheels are disposed above the plate and a second position at which said wheels are lowered to said plate, a horizontally elongated roller rotatable about its own axis and disposed at the rear edge, said wheels being engaged with the roller when the mechanism is in the second position and a motor for rotating said roller.

The machine employs first and second spaced apart photoelectric circuits, each circuit producing a vertical light beam, which, when not interrupted, passes said rear edge, said beams defining a vertical plane.

The machine also employs a third photoelectric circuit producing a horizontal light beam which, when not interrupted, passes horizontally along said rear edge parallel to said plane;

First means is connected between said first and second circuits and said mechanism and is responsive to the interruption of both vertical beams when material to be folded is placed upon said plate in the path of both beams to place said mechanism in said second position, said mechanism being otherwise in the first position.

Second means is coupled to said first means, said third circuit and said motor to actuate said motor and rotate said roller only when said mechanism is in the second position and the horizontal beam is not interrupted.

As a result, if the material to be folded is improperly positioned, one or both vertical beams will not be interrupted, the input wheels will remain in raised position, the input roller will not rotate and no folding action can take place.

If the material is properly positioned, both vertical beams will be interrupted and the wheels will be lowered. However, as long as the operators hands are not removed the horizontal beam will be interrupted since these hands will be in the path of this beam. The input roller will not rotate and again no folding action can ensue.

However, if the material is properly positioned, as soon as the operator removes his hand, the roller will rotate and folding action will take place in proper manner.

DETAILED DESCRIPTION OF PREFERRED EMBODIMENT

Figure 1:
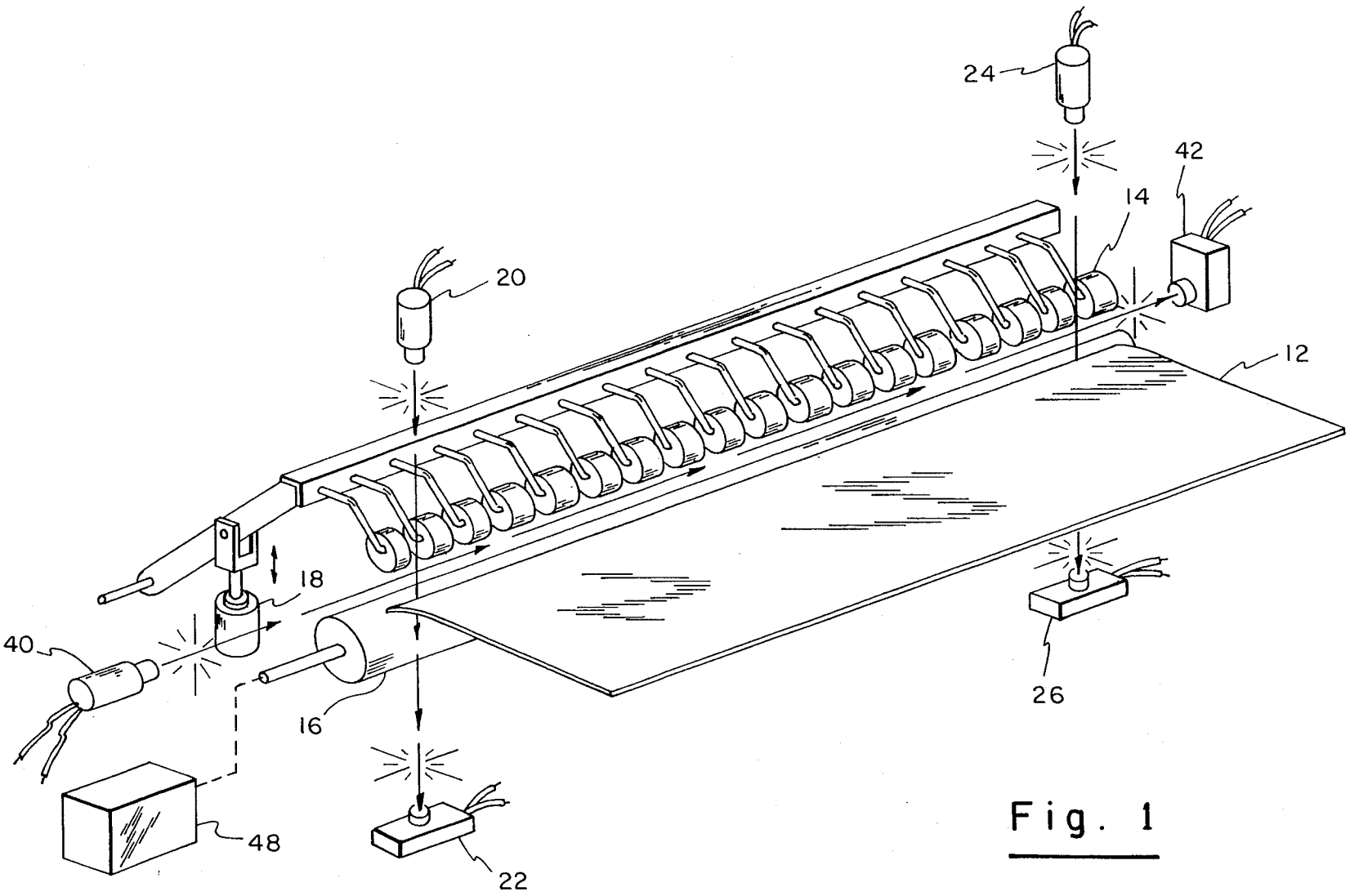
FIG. 1 is a perspective view of the invention.
Figure 2:
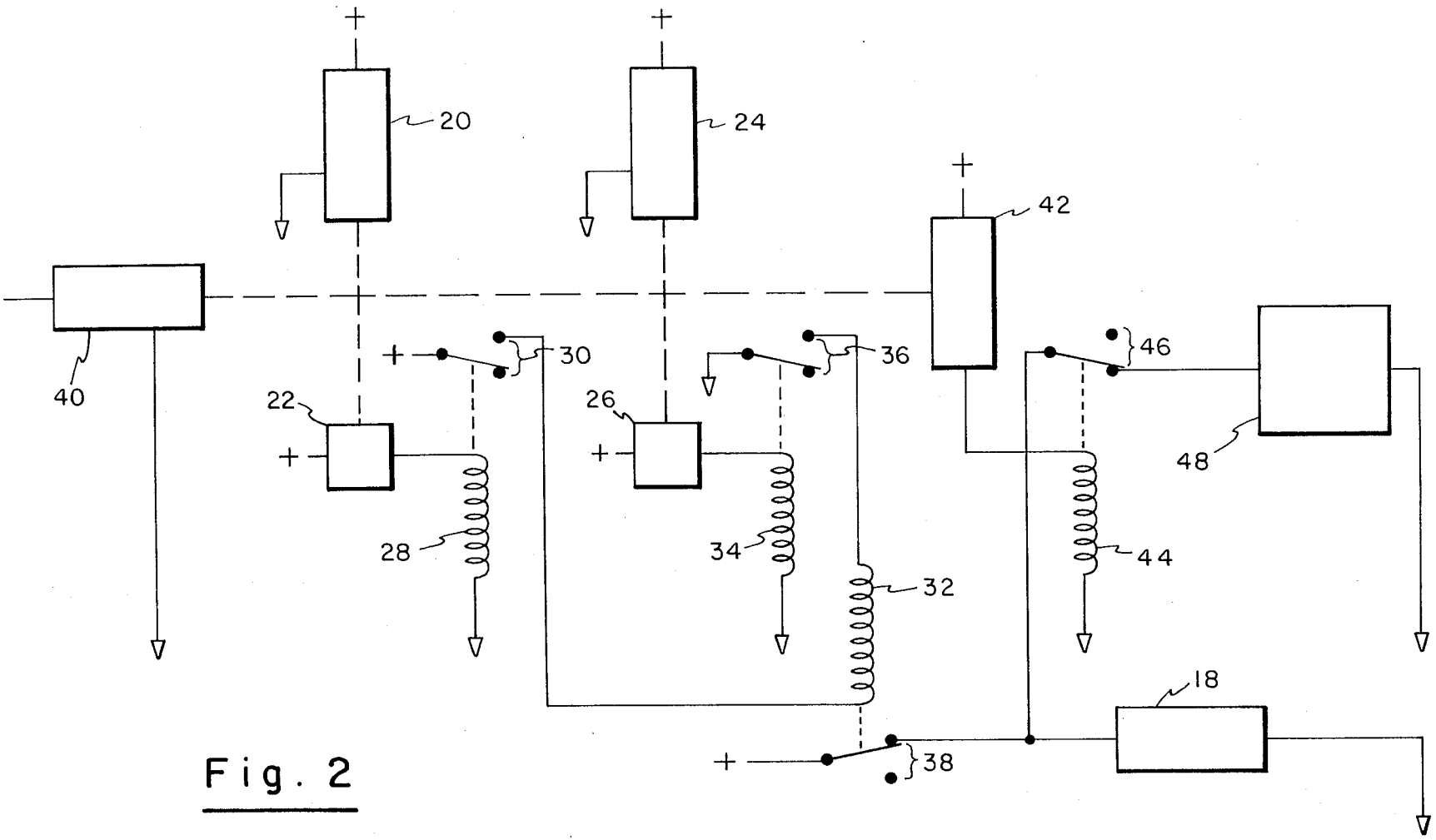
FIG. 2 is a circuit diagram thereof.

Referring now to the Figures, an operator places the leading edge of a curtain, sheet or other material 10 to be folded on an upwardly inclined horizontal plate 12 having horizontal front and rear edges so that the leading edge of the material overlies the rear edge of the plate between normally raised input wheels 14 and a horizontal input roller 16. The wheels are connected by a shaft and linkage to an air solenoid 18. When the solenoid 18 is deenergized, the wheels are in normally raised position. When the solenoid 18 is energized the wheels are lowered to engage the roller.

First and second photoelectric circuits are disposed in spaced position along the rear edge of the plate.

The first circuit employs a lamp 20 disposed above the plate which directs a vertical light beam downwardly onto a photocell 22 disposed below the plate. The second circuit employs a lamp 24 which directs a vertical light beam downwardly onto a photocell 28 disposed below the plate. The two vertical beams define a vertical plane.

When the material to be folded is properly positioned for folding, both vertical beams are interrupted.

Cell 22 becomes a high impedance and relay 28, which is energized as long as the beam associated with cell 22 strikes same and places this cell in its low impedance state, is deenergized. The set of make break contacts 30 of relay 28 then applies a high potential to one side of the winding of relay 32.

Similarly cell 26 becomes a high impedance and normally energized relay 34 becomes deenergized. The set of make break contacts 36 of relay 34 then grounds the other side of the winding of relay 32.

Relay 32 is then energized and its set of make-break contacts 38 applies a high potential to air solenoid 18 and energizes it whereby the wheels are lowered and squeeze the leading edge of the material against the top surface of roller 16.

If the material to be folded is improperly positioned so that its leading edge is partially offset or not aligned with the rear edge of the plate at least one of the vertical beams will not be interrupted, relay 32 will not be energized, the wheels will remain raised and no folding action can take place.

A third photoelectric circuit has a lamp 40 disposed at one side of the plate adjacent and above the rear edge and a photocell 42 disposed at the other side of the plate adjacent and above the rear edge, lamp 40 directing a horizontal light beam onto cell 42, this beam being parallel to and perhaps essentially coincident with the vertical plane of the two vertical beams.

When the hands of the operator or other obstruction has been removed from the path of the horizontal beam, relay 44 connected to cell 42 is energized. If relay 32 is energized a high potential is applied via the make break contact set 38 of relay 32 and the make-break contact set 46 of relay 44 to input roller motor 48 which then rotates the roller and initiates the folding action as illustrated for example in U.S. Pat. No. 4,264,066.

However, if the horizontal beam is interrupted as for example if the operators hands are not removed, relay 44 will be deenergized and the roller will not rotate.

It will be seen that even if there is no obstruction for the horizontal beam, if either or both vertical beams are not interrupted, relay 32 will not be energized and again the roller will not rotate.

What is claimed is:

1. In a folding machine having a horizontally elongated input plate with front and rear horizontal edges, a mechanism including input wheels disposed at the rear edge, said mechanism having a first position at which said wheels are disposed above the plate and a second position at which said wheels are lowered to said plate, a horizontally elongated roller rotatable about its own axis and disposed at the rear edge, said wheels being engaged with the roller when the mechanism is in the second position and a motor for rotating said roller, in combination:

first and second spaced apart photoelectric circuits, each circuit producing a vertical light beam, which, when not interrupted, passes said rear edge, said beams defining a vertical plane;

a third photoelectric circuit producing a horizontal light beam which, when not interrupted, passes horizontally along said rear edge parallel to said plane;

first means connected between said first and second circuits and said mechanism and responsive to the interruption of both vertical beams when material to be folded is placed upon said plate in the path of both beams to place said mechanism in said second position, said mechanism being otherwise in the first position; and second means coupled to said first means, said third circuit and said motor to actuate said motor and rotate said roller only when said mechanism is in the second position and the horizontal beam is not interrupted.

2. A folding machine comprising:

a horizontally elongated input plate having front and rear horizontal edges;

a mechanism including input wheels disposed at the rear edge, said mechanism having a first position at which said wheels are disposed above the plate and a second position at which the wheels are lowered to the plate;

a horizontally elongated roller rotatable about its own axis and disposed at the rear edge, said wheels being engaged with the roller when the mechanism is in the second position;

a motor for rotating said roller;

first and second spaced apart photoelectric circuits, each circuit producing a vertical light beam, which, when not interrupted, passes said rear edge, said beams defining a vertical plane;

a third photoelectric circuit producing a horizontal light beam which, when not interrupted, passes horizontally along said rear edge parallel to said plane;

first means connected between said first and second circuits and said mechanism and responsive to the interruption of both vertical beams when material to be folded is placed upon said plate in the path of both beams to place said mechanism in said second position, said mechanism being otherwise in the first position; and second means coupled to said first means, said third circuit and said motor to actuate said motor and rotate said roller only when said mechanism is in the second position and the horizontal beam is not interrupted.

3. A machine as set forth in claim 2 wherein said first means includes first and second relays, each relay being deenergized when the beam of the corresponding one of the first and second circuits is interrupted and being energized when said beam is not interrupted.

4. A machine as set forth in claim 3 wherein said first means includes a third relay which is energized only when both of said first and second relays are deenergized.

5. A machine as set forth in claim 4 wherein said second means includes a fourth relay which is deenergized when the beam of the third circuit is interrupted and is energized when the beam is not interrupted.

6. The machine as set forth in claim 5, wherein each of the first and second relays has a set of make and break contacts, the set of the first relay being connected to one end of the winding of the third relay, the set of the second relay being connected to the other end of the winding of the third relay.

7. The machine as set forth in claim 6 wherein each of the third and fourth relays has a set of make and break contacts, the set of the third relay being connected to the set of the fourth relay.

* * * * *